United States Patent [19]

Sadler, Jr. et al.

[11] Patent Number: 4,830,407

[45] Date of Patent: May 16, 1989

[54] EVENT REMINDER DEVICE

[76] Inventors: Stanley R. Sadler, Jr., 14885 Hatfield Rd., Rittman; James M. Cisar, 5309 S. Cleveland-Massillon Rd., Norton, both of Ohio 44203

[21] Appl. No.: 61,818

[22] Filed: Jun. 15, 1987

[51] Int. Cl.[4] ..... B42D 15/00; G09F 9/40

[52] U.S. Cl. ..... 283/102; 116/308; 283/51; 283/900

[58] Field of Search ..... 116/308, 325, 326, DIG. 23; 283/48 R, 51, 99, 102, 105, 900–901, 903; 40/107, 110; 206/459, 534, 831

[56] References Cited

U.S. PATENT DOCUMENTS

| | | | |
|---|---|---|---|
| 2,179,168 | 11/1939 | Alexander | 283/102 |
| 2,833,064 | 5/1958 | Parker | 116/306 |
| 3,757,441 | 9/1973 | Baustin | 40/2 R |
| 3,854,581 | 12/1974 | Jones, Jr. | 206/459 |
| 3,983,645 | 10/1976 | Rycroft | 283/105 |
| 3,993,814 | 11/1976 | Cavender | 283/101 |
| 4,340,141 | 7/1982 | Fischer | 206/531 |
| 4,634,149 | 1/1987 | Donovan | 283/102 |
| 4,637,635 | 1/1987 | Levine | 283/101 |

*Primary Examiner*—William A. Cuchlinski, Jr.
*Assistant Examiner*—W. Morris Worth
*Attorney, Agent, or Firm*—Renner, Kenner, Greive, Bobak, Taylor & Weber

[57] ABSTRACT

A label on which a grid-like pattern of detachable recording spaces is provided. The recording spaces are overprinted with a removeable coating formulated to provide a readily apparent visual contrast with the underlying coated substrate when the coating is removed. The recording spaces are designated to represent events, times of events, or both, by their association with identifying indicia on the label, and the occurrance or non-occurrance of the same is recorded by removing the coating from the appropriate spaces. Other labels incorporating security features are also taught. The label can be modified to meet specific recording needs by detaching and discarding appropriate recording spaces by tearing them from the label along provided perforated lines.

12 Claims, 1 Drawing Sheet

EVENT REMINDER DEVICE

TECHNICAL FIELD

This invention relates to sheets and labels for recording and bringing to mind past, present, or prospective events and actions. More particularly this invention relates to labels, affixable to containers, which can be modified to show when certain desired actions have taken place. Specifically, this invention relates to labels for containers designed to hold medications, which can be optionally modified by detaching removeable portions thereof, so that the action recording areas thereof can be made to correspond to specified events, for example, the times at which medications are to be taken.

BACKGROUND OF THE INVENTION

With advances in medicine has come a corresponding need for additional treatments and medications. Pharmaceutical companies have developed and made available ever-increasing numbers of medications suitable for prescription by doctors to their patients. Medication on particular days is normally called for, commonly at intervals during the day, and often, more than one type of medicine is required. Frequently, sophisticated medical and pharmacological advances have been accompanied by a corresponding increase in the potency of the medications, and the consequences of over or under dosage is quite often severe. Consequently, it is presently more important than ever that patients maintain accurate records of dosages which they have administered to themselves.

Unfortunately, many of the individuals who most need such medications have an impaired physical or mental condition which interferes with their ability to remember the medicines which they have taken. In addition, many such patients lack the manual dexterity needed to use writing implements to maintain the required records.

U.S. Pat. No. 3,675,620 has recognized the problem, and has suggested the use of a system involving removeable labels or pegs individually identifiable with dosage intervals. While the system therein described is an improvement, unfortunately, it is inflexible in the sense that there is no way to modify the system to correspond to an individual's personal needs for medication. In other words, it is difficult to incorporate into the system taught the dosage periods and related matters prescribed for a particular person, having specific, personal needs. An attempt to employ a label system designed to respond to all needs within a broad spectrum of dosage possibilities not only is confusing, but it can easily lead to mistakes by impaired individuals. Furthermore, the labels and marker pegs upon which the system taught by the patent depends, can easily, inadvertantly become dislodged or lost.

DISCLOSURE OF THE INVENTION

It is a first aspect of the herein disclosed invention, therefore, to provide a reminder system that is not only simple to use, but is not conducive to the commission of errors, even by inattentive or infirmed individuals.

A second aspect of the invention is the provision of a reminder system which may be desirably and optionally modified to meet the specific needs of a particular user.

Another aspect of the invention is to furnish a system which need not depend upon, or involve dislodgeable tabs or other markers.

It is an additional aspect to provide a reminder system which in some embodiments, may be operated by a user without any need for writing implements to record entries.

A further aspect is to provide in some embodiments a reminder system that is tamper resistant, or allows for authorized use only.

A still further aspect of the invention taught is to provide a reminder system that is inexpensive and readily manufactured with existing technology and equipment.

An additional aspect is the provision of a reminder system for individuals required to take medications, which is easy to understand and use, and is particularly adapted to use by aged, impaired, or inattentive individuals.

The foregoing and other aspects of the invention described herein are achieved by a reminder device which includes a sheet having a grid pattern displayed thereon, said pattern comprising vertical and horizontal columns of enclosed recording spaces, said enclosed recording spaces being covered with an indicating material, and said sheet being adapted to having at least some of said spaces optionally detached therefrom, whereby the occurance, or non-occurance of events can be recorded by removing said material from selected recording spaces, and whereby the number of anticipated events can be matched with available recording spaces by detaching appropriate recording spaces from said sheet.

The foregoing and other aspects of the invention are also achieved by an adhesive-coated label for a container comprising adjacent strips of recording spaces, said recording spaces forming a grid-like pattern on said label, and being covered with a removeable, visually identifiable indicator material, wherein at least some of said recording spaces are optionally removeable from said label, so that indicia printed on said label can be matched with recording spaces corresponding to a selected number of occurances, times, or both, thereby allowing the label to serve as a reminder thereof.

BRIEF DESCRIPTION OF THE DRAWINGS

The invention will be better understood when reference is had to the following drawings, in which like numbers refer to like parts.

BEST MODE FOR CARRYING OUT THE INVENTION

Figure 1:
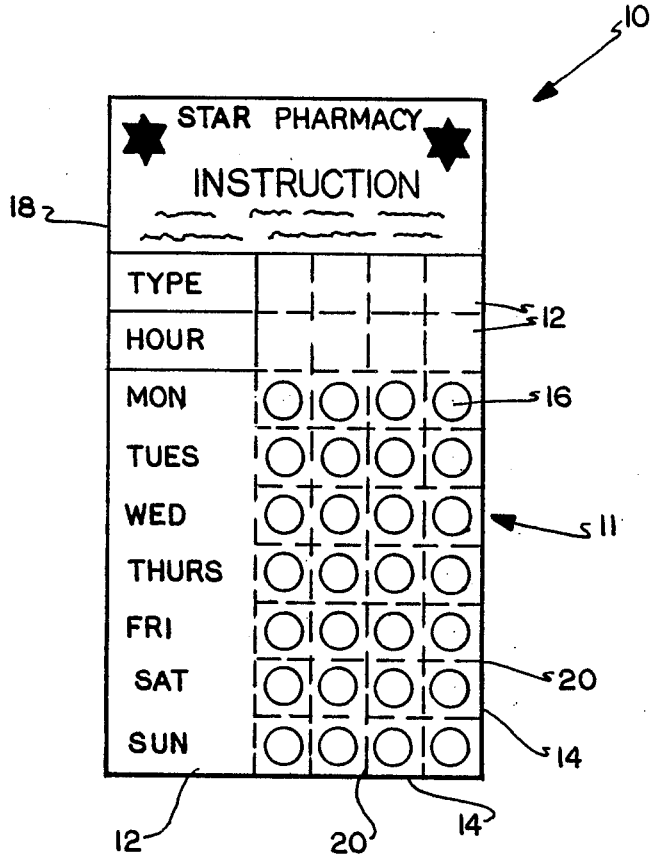
FIG. 1 is a plan view of a reminder device of the invention.

FIG. 1 is a plan view of the reminder device of the invention, shown generally by the numeral 10, comprising a sheet of material 11 on which is provided spaces 12, on which the events which it is desired to track and keep a record of are recorded. In FIG. 1, which illustrates a label for a medication container, days of the week on which medication is required, together with the type and hour for application may be displayed. Sheet 11 also contains a number of occurance columns 14, both horizontal and vertical, in which confirmation recording spaces 16 are arranged in a vertical-horizontal, grid-like pattern. Sheet 11 may also optionally contain a descretion area 18 in which instructions, advertising, and the like may be set out. It will be noted that a number of the occurrance spaces or columns 14 may be detached from sheet 11 by tearing and separating the spaces or columns from the sheet along detachment perforations 20.

To use the reminder device 10 the days of medication, hours of application, and types are first ascertained, following which suitable modification of the reminder device 10 is made by detaching the columns or portions thereof which have no relevance to the particular needs of the patient. For example, if the medication prescribed is required only twice a day, two of the vertical columns 14 would be detached. Likewise, if medication is only required every other day, horizontal columns would be removed corresponding to days on which medication is not required. Thereafter the label reminder device in the case illustrated in the Figure is affixed to the medicine container and given to the patient. Upon taking the required medication at the time indicated on the suitably altered label 10, the patient merely treats the indicator material, for example, by scratching a removeable coating covering the appropriate confirmation space 16, exposing a substrate capable of visually indicating that the act of medication has occurred.

The dimensions of the reminder device 10 will depend upon the use for which the device has been designed. For instance, in the case of a label for a medical container the label will commonly be about 1 to 1½ inches wide by about 2 to 3 inches high. The dimensions of the columns and other spaces on the label will be determined, among other things, by the particular use for which the device has been designed. The reminder devices of the invention can be used for medications, as described, but are also capable of a wide variety of other uses which will readily occur to the practitioner, including the recording of non-medical events, and other occurances or non-occurances. The numbers of columns, either horizontal, or vertical may also be varied at the discretion of, and to meet the needs of the situation in connection with which the reminder is to be employed. The reminder device 10 can be laid out in a format other than that shown in FIG. 1, and can include in addition, or instead of instructions and advertising, other information, as well as designations describing activities unrelated to medications, and confirmations of events in terms other than those relating to days and hours.

Detachment of occurance columns 14, including horizontal or vertical portions thereof, or individual confirmation spaces 16 is facilitated by perforating, scoring, or otherwise weakening the margins between the confirmation spaces 16.

Figure 2:
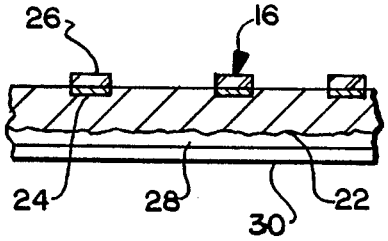
FIG. 2 is a fragmentary cross-section along the edge of the device of FIG. 1.

FIG. 2 shows a fragmentary cross-section taken across a series of confirmation spaces of the device shown n FIG. 1. In the Figure, which represents a container label designed to be fastened to a container by means of a pressure sensitive adhesive, there is shown a sheet 22 with confirmation spaces 16 arranged thereon which comprise a confirmation substrate 24, and a removeable coating 26. A layer of pressure sensitive adhesive 28 is disposed on the underside of sheet 22, covered by a backing layer 30. In the process of affixing a label to a container, the backing layer 30 is removed, exposing the pressure sensitive adhesive 28, a technique well known in the art. While a pressure sensitive attachment method is illustrated, the label may be secured to a container with ordinary adhesives, either those disposed on the label, made operative by moistening, or by first applying the adhesive to the container and immediately pressing the label thereon. The sheet 22 can be made from any suitable material, paper, plastic, etc.; however, paper is preferred. In instances where the reminder device is used in application where it is desired to avoid tampering by unauthorized persons, as for example, in the case of a label indicating an expiration date on perishable goods, the fabrication of the label from a material destroyed by attempted alteration is desired, such materials being well known in the art. Typically, in the case of a medication label, the label is suitably modified by the pharmacist or doctor to conform to the dosage instructions by detaching appropriate portions thereof as previously described, completing the event columns 12, as required, and then affixing the labels to the container.

The confirmation spaces 16 comprise the substrate 24, which may simply be sheet 22, or the substrate may comprise the sheet which has been suitably printed with a color, mark, or the like. The removable coating 16 comprises a coating or overprinting on top of the substrate, which can be of any shape desired, for example, a circle, square, star, or other. The removeable coating is of the type well known in the art including air dried latex, heat-settable coatings and the like, and may be placed over the substrate by silk screening, overprinting, or by other techniques. Removable tabs, although not preferred, may also be used if necessary. The function of the confirmation space is simply to provide an identifying contrast between the coating, and the substrate covered by it, so that when the coating is removed, for instance, by abrasion with a fingernail, the absence of the coating is easily, visually noted. Such contrast may be provided by including a color pigment in the coating which is different from the color of the substrate. The pigment may either produce opacity, translucency, or be transparent, so long as the desired contrast is achieved. While contrast may be obtained by a coating and substrate having different colors, it may also be achieved, for example, by removal of an opaque coating to disclose some underlying mark or other identification to confirm its removal.

In some instances, where changes by unauthorized persons must be avoided, the use of an opaque coating which becomes translucent upon application of a chemical, for example, that carried in a felt tip pen issued only to authorized individuals, can be employed. In other situations, it may be desirable to effect a desired indicator change through contact with an implement capable of applying heat, pressure, or both to the appropriate space.

While in accordance with the patent statutes, a preferred embodiment and best mode has been presented, the scope of the invention is not limited thereto, but rather is measured by the scope of the attached claims.

What is claimed is:

1. A reminder device which includes a sheet having a grid pattern displayed thereon, said pattern comprising vertical and horizontal columns of enclosed recording spaces, said enclosed recording spaces being coated with an indicating material, and said sheet being adapted to having at least some of said spaces optionally detached therefrom, said sheet is printed on a non-detachable portion thereof with indicia relating recording spaces to recordable events, said indicia being aligned with said horizontal and vertical columns, whereby the occurance and non-occurrance of events can be recorded by removing said material from selected recording spaces, and whereby anticipated events can be matched with available recording spaces by detaching appropriate recording spaces from said sheet.

2. A reminder device according to claim 1 in which said sheet is paper containing a layer of adhesive thereon by means of which said sheet can be fastened to a desired object.

3. A reminder device according to claim 2 in which said adhesive is a pressure sensitive adhesive.

4. A reminder device according to claim 2 in which at least some of said recording spaces can be detached by tearing said recording spaces along perforations provided adjacent thereto, thereby separating said recording spaces from said device.

5. A reminder device according to claim 1 in which said indicator material is a coating made identifiable by inclusion of a pigment therein, and said coating can be removed from said sheet by mechanically abrading said coating on the recording space on which it has been placed.

6. A reminder device according to claim 5 wherein the pigment in said removeable coating is of a different color than a substrate on which it is coated.

7. An adhesive-coated label for a container comprising adjacent strips of recording spaces, said recording spaces forming a grid-like pattern on said label, and being coated with a removeable, visually identifiable indicator material, wherein at least some of said recording spaces are optionally removeable from said label so that indicia identified with selected occurrences, times, or both and printed on said label and aligned with said grid-like pattern can be matched with recording spaces by removal of said indicator material, thereby allowing the label to serve as a reminder thereof.

8. A label according to claim 7 in which said recording spaces are arranged in vertical and horizontal columns, and at least some of said recording spaces are detachable along perforated lines contained on said label.

9. A label according to claim 8 wherein said indicator material is a coating formed from a pigmented latex which is placed over said recording spaces by overprinting.

10. A label according to claim 7 wherein said container is designed to hold medications, and said label provides a reminder to a user regarding the medications and proper times of medication by visual inspection of said recording spaces in relation to the indicia printed on the label.

11. A label according to claim 1 wherein said indicator material is a coating, the appearance of which may be altered to record the occurrence and non-occurrence of events by a process selected from one of a process involving treatment with a suitable chemical substance, a process involving the application of one of heat, pressure, and a combination of heat and pressure.

12. A reminder device according to claim 1 wherein said sheet is fabricated from a material which is made unuseable by an attempted alteration thereof.

* * * * *